US005994632A

United States Patent [19]

Muramatsu et al.

[11] Patent Number: 5,994,632

[45] Date of Patent: Nov. 30, 1999

[54] AUTOMATIC PLAYER PIANO WITH MAGNETIC VELOCITY SENSOR SHIELDED FROM SOLENOID-OPERATED KEY ACTUATORS

[75] Inventors: Shigeru Muramatsu; Syuzo Okabe, both of Shizuoka, Japan

[73] Assignee: Yamaha Corporation, Hamamatsu, Japan

[21] Appl. No.: 09/007,140

[22] Filed: Jan. 14, 1998

[30] Foreign Application Priority Data

Jan. 14, 1997 [JP] Japan ..... 9-005000
Feb. 25, 1997 [JP] Japan ..... 9-041228

[51] Int. Cl.[6] ..... G10F 1/02

[52] U.S. Cl. ..... 84/18; 84/20

[58] Field of Search ..... 84/18, 19, 20, 84/21

[56] References Cited

U.S. PATENT DOCUMENTS 3,634,877 1/1972 Cannon ..... 335/255
4,450,749 5/1984 Stahnke ..... 84/462
4,593,592 6/1986 Stahnke ..... 84/21

*Primary Examiner*—Robert E. Nappi
*Assistant Examiner*—Shih-yung Hsieh
*Attorney, Agent, or Firm*—Graham & James LLP

[57] ABSTRACT

A automatic player piano has an acoustic piano with black/white keys selectively fingered by a player, solenoid-operated key actuators selectively energized with driving signals for moving the black/white keys without the fingering, magnetic velocity sensors for detecting current velocities of the plungers of the solenoid-operated key actuators and a controller connected between the solenoid-operated key actuators and the magnetic velocity sensors and changing the magnitude of the driving signals for matching the current velocities to target velocities, and a magnetic shield structure is provided between the solenoid-operated key actuators and the magnetic velocity sensors so as to improve a signal-to-noise ratio of the detecting signals supplied to the controller.

7 Claims, 5 Drawing Sheets

AUTOMATIC PLAYER PIANO WITH MAGNETIC VELOCITY SENSOR SHIELDED FROM SOLENOID-OPERATED KEY ACTUATORS

FIELD OF THE INVENTION

This invention relates to an automatic player piano and, more particularly, to an automatic player piano equipped with solenoid-operated key actuators responsive to driving signals produced from music data codes representative of pieces of music data information.

DESCRIPTION OF THE RELATED ART

Various kinds of automatic player piano are sold in the market. The automatic player piano is a combination of an acoustic piano, solenoid-operated key actuators provided under the keyboard and a controller for selectively energizing the solenoid-operated key actuators. Pieces of music data information representative of a performance are stored in a data storage medium such as a floppy disk in the form of a music data code, and the controller sequentially reads out ale pieces of music data information. The controller produces driving signals from the music data codes, and selectively distributes the music data codes to the solenoid-operated key actuators.

While the solenoid-operated key actuators are selectively moving the keys, the controller is expected to exactly control the velocity of each plunger so as to faithfully reproduce the original performance. The prior art automatic player piano measures the velocity of the plunger incorporated in the solenoid-operated key actuator, and regulates the driving signal to appropriate value so as to match the current velocity to the target velocity. Thus, the prior art automatic player piano exactly controls the plunger motion through the feedback loop.

In order to measure the current plunger velocity, the controller requires a velocity sensor associated with the solenoid-operated key actuator. A magnetic velocity sensor is assembled with the solenoid-operated key sensor, and measures the current plunger velocity. The magnetic velocity sensor includes a magnetic rod and a coil. The coil of the magnetic velocity sensor is referred to as "sensor coil" for discriminating it from the solenoid of the key actuator. The magnetic rod is coaxially attached to one end of the plunger, and is movable together with the plunger. When the controller energizes and, thereafter, demagnetizes the solenoid-operated key actuator, the magnetic rod is moved together with the plunger, and is projected into and retracted from the sensor coil. The magnetic rod induces electric current in the sensor coil, and the amount of electric current is dependent on the velocity of the magnetic rod and, accordingly, the plunger velocity. The electric signal is supplied to the controller, and the controller determines the current plunger velocity on the basis of the magnitude of the electric signal.

If the sensor coil is long enough to accommodate the magnetic rod, the magnetic velocity sensor produces a high-resolution electric signal exactly proportional to the plunger velocity, and is desirable for the velocity sensor. However, the solenoid of the key actuator is close to the magnetic velocity sensor, and the magnetic field thereof affects the coil. The solenoid closed to the sensor coil is causative of magnetic noise, and the magnetic noise deteriorates the signal-to-noise ratio of the electric signal.

If the magnetic velocity sensor is sufficiently spaced from the solenoid of the key actuator, the magnetic influence is reduced, and, accordingly, the signal-to-noise ratio is improved. In order to space the magnetic rod from the plunger, a non-magnetic spacer would be inserted between the plunger and the magnetic rod. Another factor for improvement of the signal-to-noise ratio is to increase the ratio of the internal magnetic variation to the external magnetic variation, because the signal-to-noise ratio is proportional to the ratio of the internal magnetic variation to the external magnetic variation. One of the practical approaches is to decrease the diameter of the sensor coil so as to make the magnetic rod as close to the sensor coil as possible.

The above described two countermeasures are hardly employed in the magnetic velocity sensor. This is because of the fact that the non-magnetic spacer tends to misalign the plunger with the magnetic rod and that the magnetic rod is liable to bring the outer surface in contact with the sensor coil. For this reason, the manufacturer increases the diameter of the sensor coil so as to prevent the magnetic rod from the undesirable contact with the sensor coil. The large sensor coil reduces the resolution of the electric signal. Moreover, the manufacturer can not widely space the magnetic rod from the plunger. If a Iona non-magnetic spacer is inserted between the plunger and the magnetic rod, the long non-magnetic spacer enlarges the magnetic velocity sensor, and the large magnetic velocity sensor is hardly installed in the acoustic piano.

SUMMARY OF THE INVENTION

It is therefore an important object of the present invention to provide an automatic player piano, a magnetic velocity sensor of which is small and low in production cost without sacrifice of a signal-to-noise ratio.

To accomplish the object, the present invention proposes to shield magnetic velocity sensors.

In accordance with one aspect of the present invention, there is provided a keyboard musical instrument comprising an acoustic keyboard musical instrument having a plurality of keys selectively moved by a player for producing acoustic sounds, a plurality of solenoid-operated key actuators having respective solenoids selectively energized with driving signals and respective plungers for selectively moving the plurality of keys in the presence of magnetic field created by the solenoids, a plurality of magnetic velocity sensors having respective magnetic rods coaxially attached to the associated plungers and respective coils respectively associated with the magnetic rods for producing feedback control signals representative of current velocities of the plungers, a controlling system connected between the plurality of solenoid-operated key actuators and the plurality of magnetic velocity sensors, and responsive to the feedback control signals for regulating the magnitude of the driving signals, and a magnetic shield member provided between the solenoids and the coils, and preventing the coils from the magnetic field.

BRIEF DESCRIPTION OF THE DRAWINGS

The features and advantages of the magnetic velocity sensor will be more clearly understood from the following description taken in conjunction with the accompanying drawings in which.

DESCRIPTION OF PREFERRED EMBODIMENT

Figure 1:
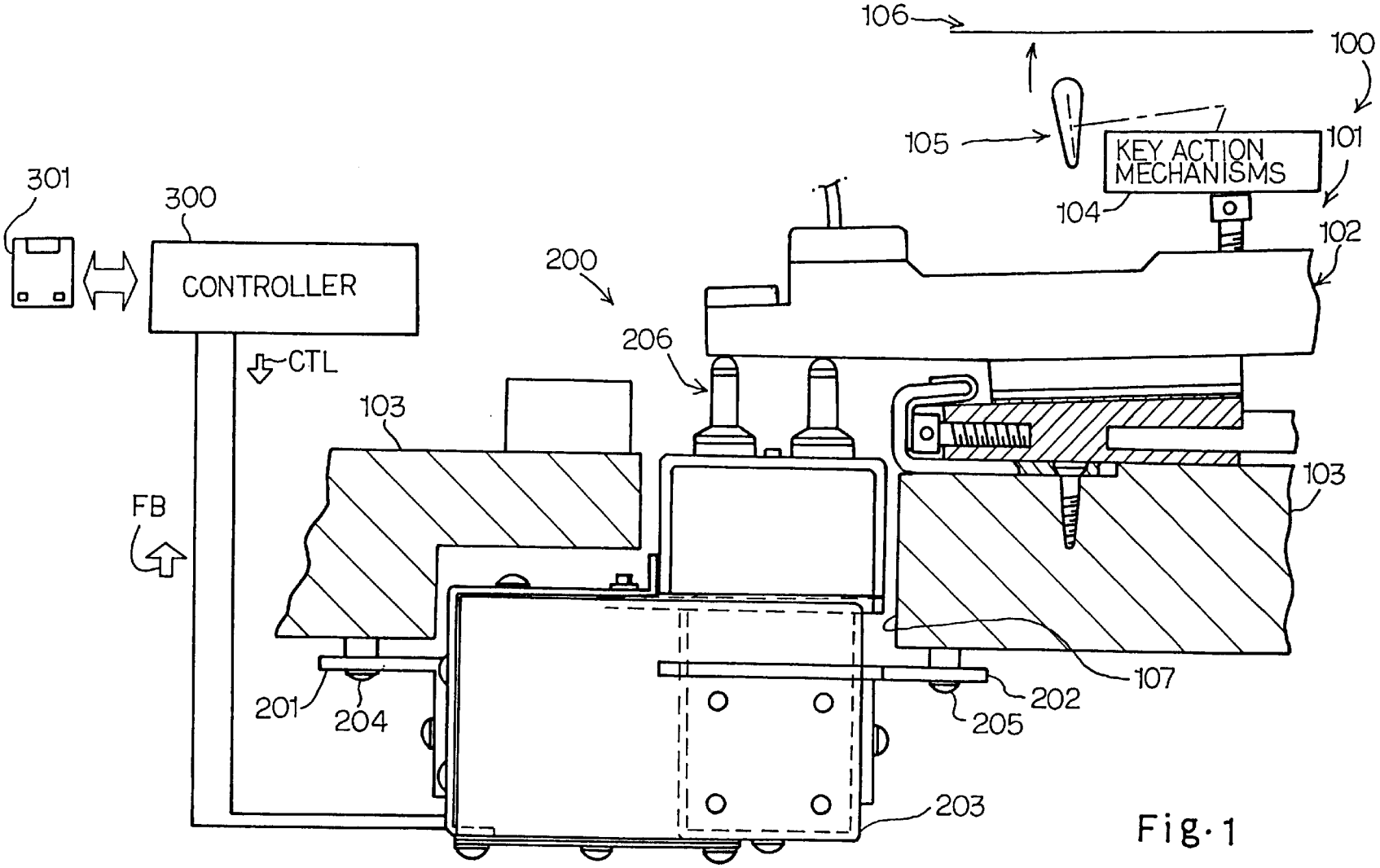
FIG. 1 is a cross sectional side view showing essential parts of an automatic player piano according to the present invention.

Referring to FIG. 1 of the drawings, an automatic player piano embodying the present invention largely comprises an acoustic piano 100, a key driving unit 200 and a controller 300. The automatic player piano has at least a standard playing mode and an automatic playing mode. In the standard playing mode, a pianist plays the automatic player piano as a standard acoustic piano, and the controller 300 cooperates with the driving unit 200 so as to play the acoustic piano without fingering. In the following description, term "front" indicates a position closer to a player than "rear" position, and a "lateral" direction is perpendicular to the direction between the front position and the rear position.

The acoustic piano 100 is a ground type, and includes a keyboard 101 implemented by a plurality of black/white keys 102, and the black/white keys 102 are turnable with respect to a key bed 103. The acoustic piano 100 further includes key action mechanisms 104 respectively connected to the black/white keys 102, a plurality of hammer assemblies 105 respectively driven for rotation by the key action mechanisms 104 and a plurality of sets of strings 106 respectively struck by the hammer assemblies 105 for producing acoustic sounds. The key action mechanisms 104 and the hammer assemblies 105 are similar to those of the standard piano, and no further description is incorporated hereinbelow.

A slit 107 is formed in the key bed 103, and extends in the lateral direction under the rear portions of the black/white keys 102. The driving unit 200 is accommodated in the slit 107. A frame structure is connected to supporting members 201/202, which in tern are fixed to the key bed 103 by means of screws 204/205. The frame structure 203 has a box-like configuration, and defines inner space therein. The driving unit 200 is supported by the frame structure 203.

Figure 2:
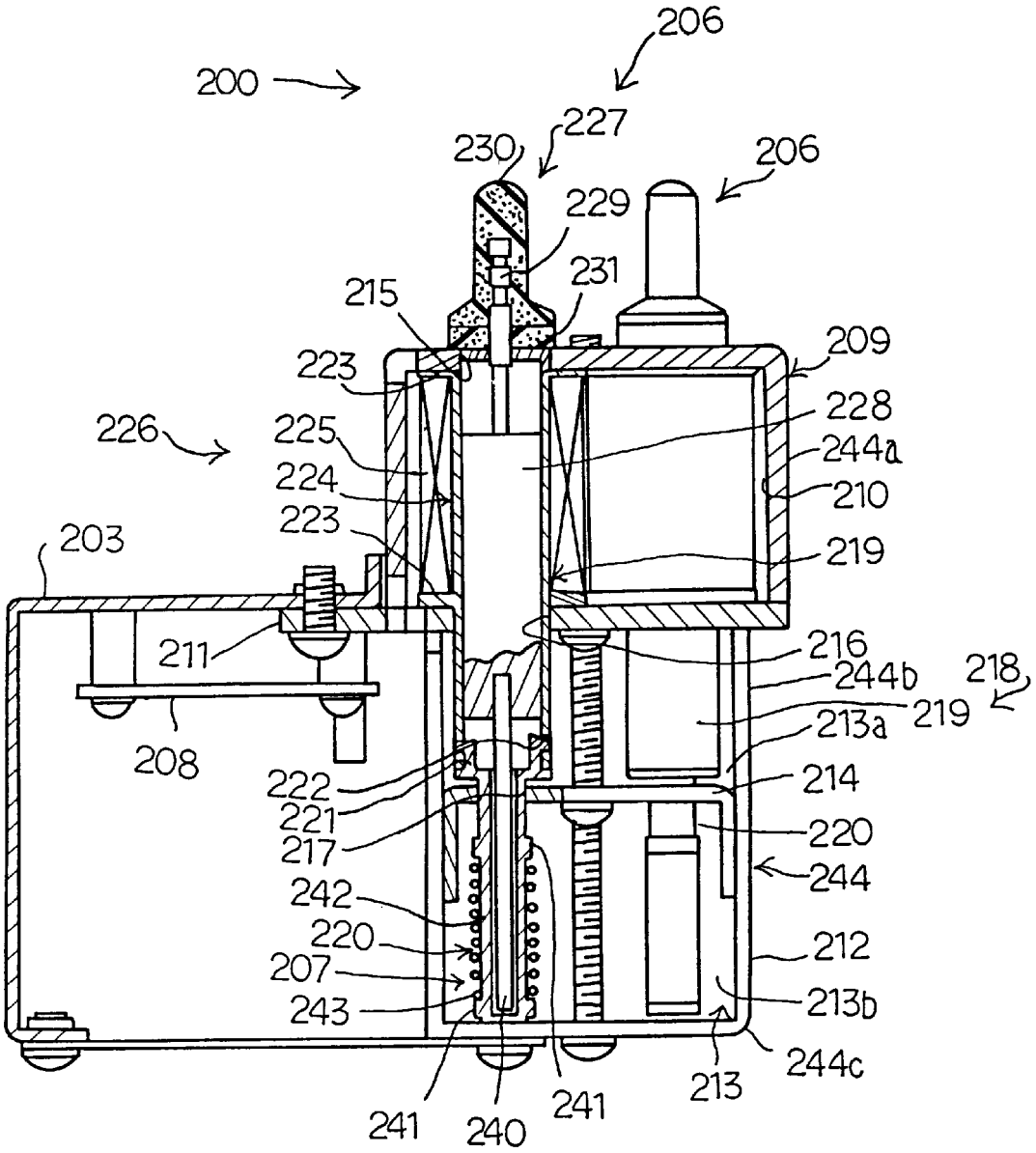
FIG. 2 is a partially cut-away side view showing solenoid-operated key actuators and associated magnetic velocity sensors accommodated in a box-like frame structure.

Turning to FIG. 2 of the drawings, the driving unit 200 includes a plurality of solenoid-operated key actuators 206 arranged in a staggered fashion in the lateral direction, a plurality of magnetic velocity sensors 207 respectively associated with the solenoid-operated key actuators 206 and a driving circuit 208 for selectively energizing the solenoid-operated key actuators 206. The solenoid-operated key actuators 206 are respectively associated with the black/white keys 102, and are integrated with one another as described hereinbelow.

Turning to FIG. 2 of the drawings, each of the solenoid-operated key actuator 206 includes a main yoke 209, which is shared with the other solenoid-operated key actuators 206. The yoke 209 is formed of soft magnetic material such as iron, and defines inner space 210. A connecting portion 211 projects from the rear end of the yoke 209, and is connected to the inner surface of the frame structure 203. A channel-shaped magnetic shield member 212 is attached to the lower surface of the main yoke 209, and defines inner space 213 together with the main yoke 209. A partition wall member 214 is attached to the inner surface of the channel-shaped magnetic shield member 212, and split the inner space 213 into upper sub-space 213*a* and lower sub-space 213*b*. Thus, three spaces 210, 213*a* and 213*b* are defined by the main yoke 209, the magnetic shield member 212 and the partition wall member 214. Pairs of through-holes 215/216 are formed in the upper/lower portions of the main yoke 209, and are arranged in the staggered fashion. The inner space 210 is open to the slit 107 via the through-holes 215, and the upper sub-space 213*a* is connected to the inner space 210 via through-holes 216. A plurality of through-holes 217 are formed in the partition wall member 214, and are aligned with the pairs of through-holes 215/216. The upper sub-space 213*a* is connected to the lower sub-space 213*b* via through-holes 217. The channel-shaped magnetic shield member 212 and the partition wall member 214 are formed of soft magnetic material such as iron.

Bobbins 218 are accommodated in the inner spaces 210 and 213, and each of the bobbins 218 is assigned to one of the pairs of through-holes 215/216 and one of the through-holes 217. An upper portion 219 and a lower portion 220 are assembled into the bobbin 218, and are separable. The upper portion 219 has a relatively large diameter, and the lower portion 220 has a relatively small diameter. The upper portion 219 is snugly received in the pair of through-holes 215/216, and extends through the inner space 210 and the upper sub-space 213*a*. The lower portion 220 passes through the through-hole 217, and extends through the lower sub-space 213*b*. The lower portion 220 has resilient pawls 221, and slits 222 are formed in the upper portion 219. When the lower portion 220 is assembled with the upper portion 219, the resilient pawls 221 are deformed, and are engaged with the slits 222. As a result, the lower portion 220 is coaxially assembled with the upper portion 219.

A pair of brim portions 223 project from the upper portion 219, and the brim portions are spaced from each other. The upper portion 219 between the brim portions 223 serves as a bobbin portion 224, and a coil 225 is wound on the outer surface of the bobbin portion 224. The coil 225 is connected to the driving circuit 208. The bobbin portion 224 and the coil 225 form in combination a solenoid 226.

A plunger 227 is accommodated in the inner space of the upper portion 219. The plunger 227 has a boss portion 228 slidable in the inner space of the upper portion 219, a rod portion 229 upwardly projecting from the boss portion 228 and a plunger head 230 attached to the upper end of the rod portion 229. The thick portion 228 is formed of iron, and the plunger head 230 is formed of rubber. The plunger head 230 projects from the upper portion 219, and a cushion member 231 is attached to the lower surface of the plunger head 230. The cushion member 231 is, by way of example, formed of felt, and absorbs shock between the plunger head 230 and the upper portion 219. The solenoid 226 and the plunger 227 as a whole constitute each solenoid-operated key actuator 206.

When the driving circuit 208 supplies a driving signal to the coil 225, the coil 225 creates magnetic field, and the magnetic field upwardly projects the plunger 227. The plunger head 230 pushes the rear end portion of the associated key 102, and the key 102 turns so as to actuate the key action mechanism 104. When the driving circuit 208 stops the driving signal, the magnetic force is removed from the plunger 227, and the self-weight downwardly moves the plunger 227 until the cushion member 231 is brought into contact with the upper end of the upper portion 219.

A magnetic rod 240 is fixed to the boss portion 228 through a caulking, and downwardly projects from the boss portion 228. The center axis of the magnetic rod 240 is aligned with the center axis of the boss portion 228, and the magnetic rod 240 and the boss portion 228 are coaxial with each other. The magnetic rod 240 is inserted into the inner space of the lower portion 220, and the gap between the magnetic rod 240 and the inner surface of the lower portion 220 is as small as possible. A pair of brim portions 241 is formed on the outer surface of the lower portion 220, and the brim portions 241 are spaced from each other. The lower portion 220 between the brim portions 241 serves as another bobbin portion 242, and a coil 243 is wound on the bobbin portion 242. The magnetic rod 240 and the coil 243 as a whole constitute the magnetic velocity sensor 207.

When the magnetic force actuates the plunger 227, the magnetic rod 240 is also moved in the inner space of the lower portion 220, and induces electric current in the coil 243. The electric current forms a feedback control signal FB representative of current velocity of the plunger 227, and the feedback control signal FB is supplied to the controller 300. The magnetic shield member 212 and the partition wall member 214 prevents the coil 243 of the magnetic velocity sensors 207 from the magnetic influences of the solenoid 226, and the magnetic rod 240 induces the electric current exactly representing the plunger velocity in the coil 243. For this reason, the controller 300 makes the driving unit 200 and the acoustic piano 100 to faithfully reproduce the original performance. In this instance, the magnetic shield member 212 and the partition wall member 214 as a whole constitute a magnetic structure 244, and the main yoke 209 and the magnetic structure 244 form an upper shield portion 244*a*, an intermediate shield portion 244*b* and a lower shield portion 244*c*.

The driving circuit 208 is connected to the controller 300, and responsive to a controlling signal CTL representative of a magnitude of the driving signal so as to move the plunger 227 at a target velocity, and projects the plunger 227 from the bobbin 218 at a certain velocity. Though not shown in the drawings, the controller 300 includes a microprocessor, various peripheral circuits and a floppy disk driver, and produces the controlling signal CTL from music data codes read out from a floppy disk 301. The controller 300 is further operative to regulate the driving signal in response to the feedback control signal FB.

Description is made on the behavior of the automatic player piano in the automatic playing mode. Assuming now that the automatic player piano is instructed to reproduce an original performance, the controller 300 sequentially reads out the music data codes form the floppy disk, and successively supplies the controlling signals CTL to the driving circuit 208. The controlling circuit 208 produces the driving signals in response to the controlling signals CTL, and distributes the driving signals to the solenoid-operated key actuators 206. The plunger velocity is regulated to a target value through the feedback loop consisting of the controller 300, the driving circuit 208, the solenoid-operated key actuators 206 and the magnetic velocity sensors 207, and each plunger 206 exerts force equal to the force in the original performance on the associated black/white key 102. Each of the solenoid-operated key actuators 206 gives the force to the associated black/white key 102, and the black/white key 102 turns without fingering. The black/white keys 102 actuate the associated key action mechanisms 104, and the key action mechanisms 104 drive the associated hammer assemblies 105 for rotation. The hammer assemblies 105 strike the associated sets of strings 106, and return to the home position. After the strike, the controller 300 instructs the driving circuit 208 to stepwise decrease the driving signals to zero, and the plungers 227 are retracted into the bobbins 218, and the black/white keys 102 return to the rest position. In this way, the controller 300 selectively moves the black/white keys 102, and reproduces the original performance.

Figure 3:
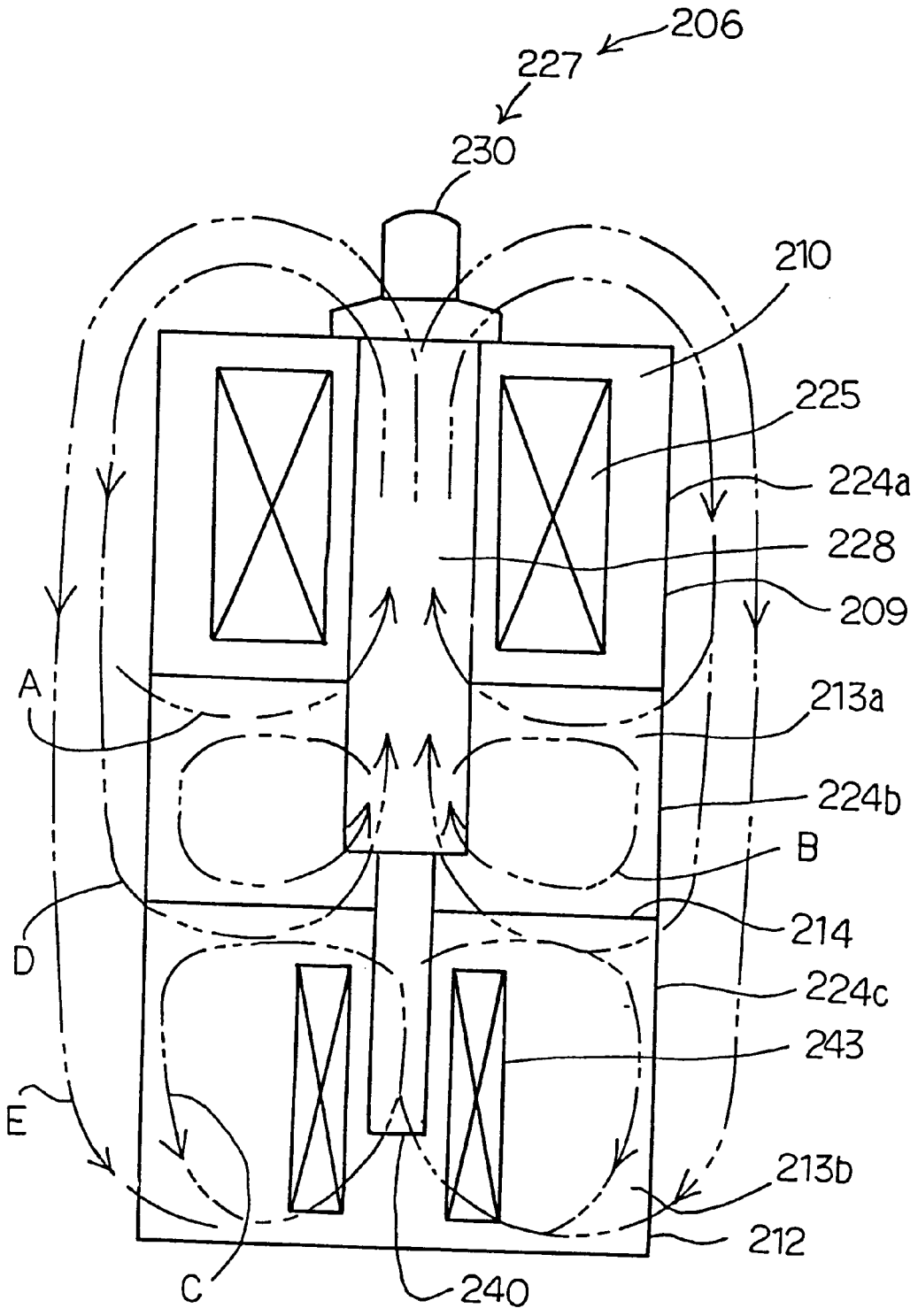
FIG. 3 is a schematic view showing the solenoid-operated key actuator associated with the magnetic velocity sensor.
Figure 4:
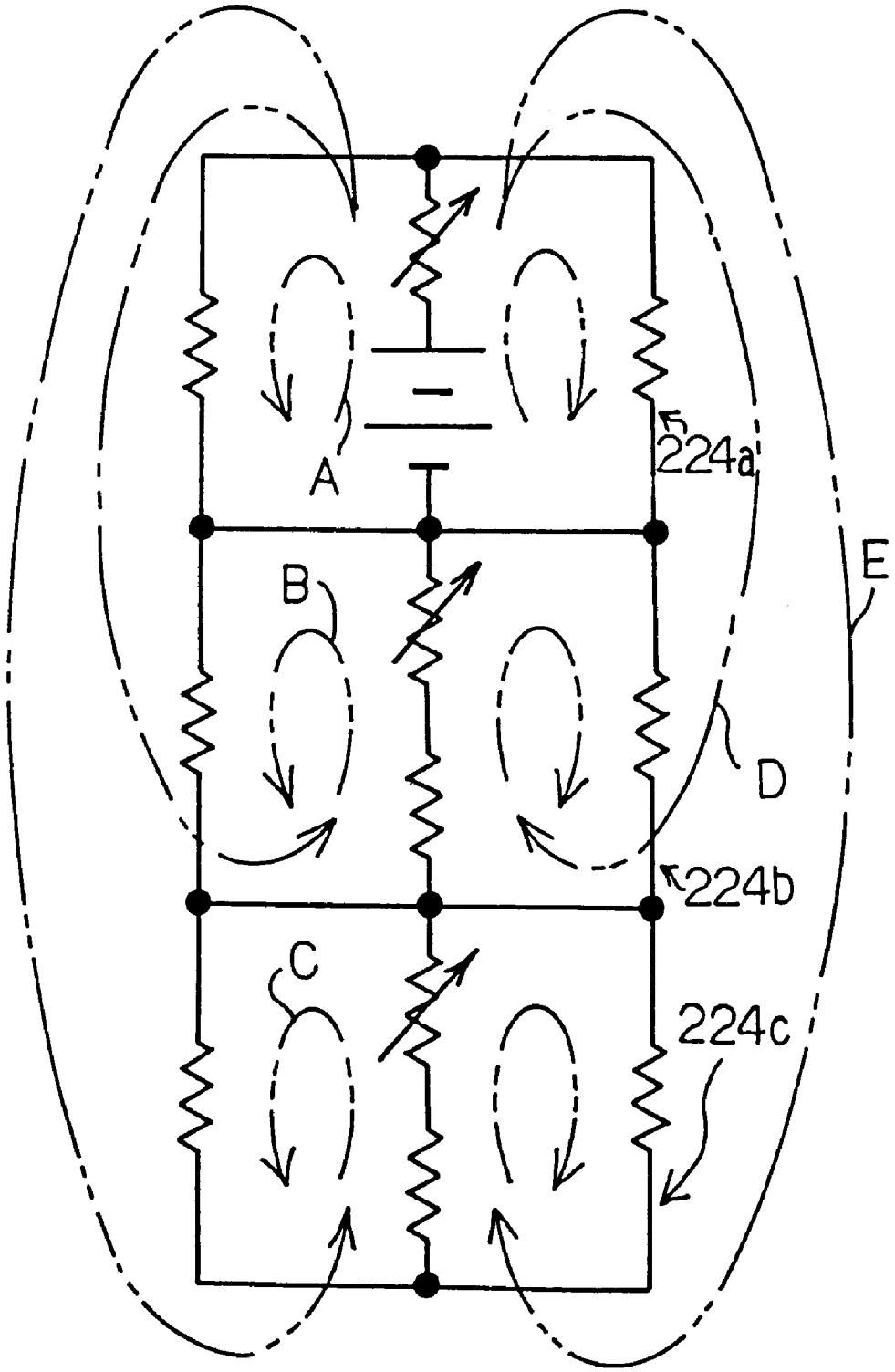
FIG. 4 is a diagram showing an equivalent circuit of the solenoid-operated key actuator and the magnetic velocity sensor.

FIG. 3 illustrates one of the solenoid-operated key actuators 206 associated with the magnetic velocity sensor 207, and FIG. 4 illustrates an equivalent circuit thereof. Loop A, loop B and loop C are representative of magnetic loops along magnetic circuits produced in the upper shield portion 244*a*, the intermediate shield portion 244*b* and the lower shield portion 244*c*, respectively. When the coil 225 is energized, the solenoid 226 generates strong magnetic field, and the magnetic fluxes are leaked through the plunger 227 into the intermediate shield portion 224*b* and the lower shield portion 224*c*. As a result, magnetic loops D and E are produced in parallel to the magnetic loop A. The magnetic loop E is causative of noise in the magnetic velocity sensor 207. However, the magnetic flux density in the loop A is much larger than the magnetic flux density in the loop D, which is much larger than the magnetic flux density in the loop E. This is because of the fact that the upper shield portion 224*a* and the intermediate shield portion 224*b* form a closed loop due to the channel-shaped shield member 212 where the upper shield portion 224*a*, the intermediate shield portion 224*b* and the lower shield portion 224*c* are magnetically connected to one another. The loop A passes the magnetic circuit in the upper shield portion 224*a*, and the loop D passes the magnetic circuit in the intermediate shield portion 224*b*. Then, the magnetic flux density of the loop E is drastically decreased, and the coil 243 is prevented from the magnetic influences.

The magnetic rod 240 is formed of the ferromagnetic material. However, the internal impedance of the magnetic rod 240 is non-ignoreable, and the magnetic flux density of the loop C is relatively small. For this reason, the magnetic rod 240 does not have any serious magnetic influence on the solenoid 226. It is recommendable to space the shield member 212 from the magnetic rod 240 so as to increase the internal impedance.

Figure 5:
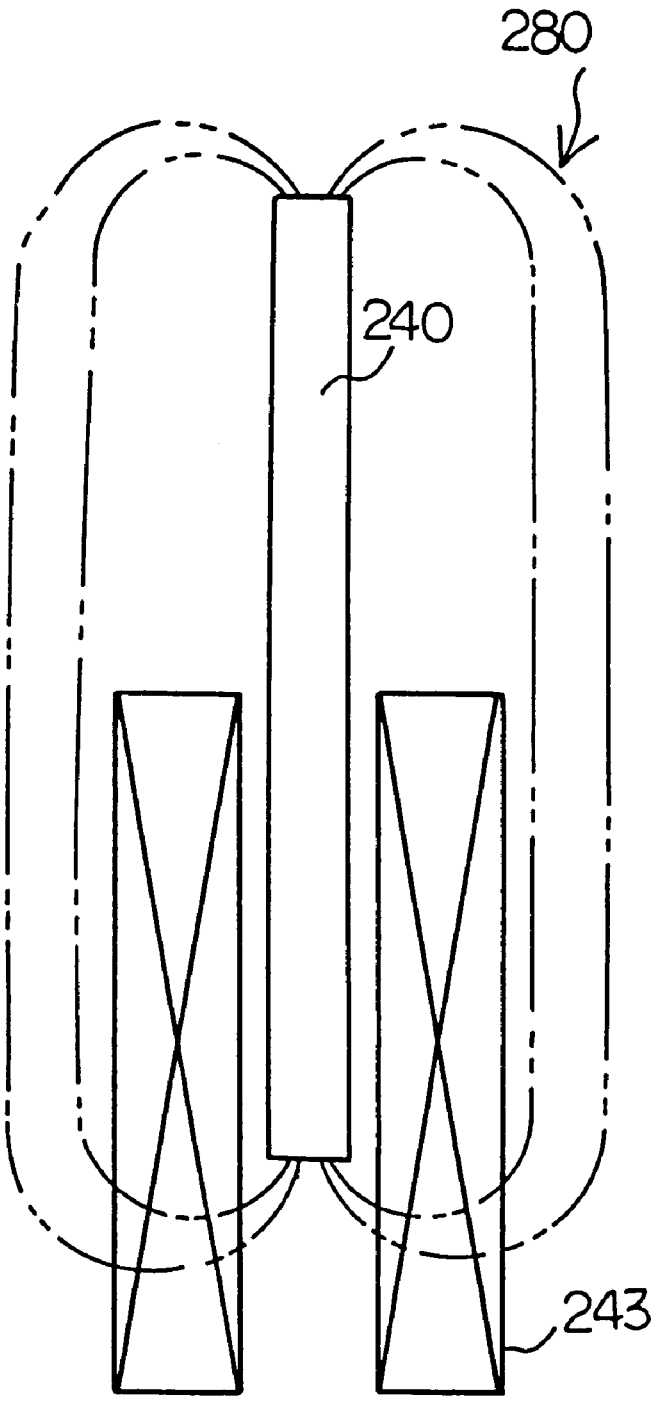
FIG. 5 is a view showing the detecting principle of the magnetic velocity sensor.

FIG. 5 illustrates the detecting principle of the magnetic velocity sensor 207. The magnetic rod 240 generates magnetic fluxes 280. When the magnetic rod 240 is moved together with the plunger 227 at velocity v, signal potential Vs is induced in the coil 243, and the potential Vs is given as follows.

$$Vs=\alpha\cdot v\cdot(d\phi/dt)\cdot N \qquad \text{Equation 1}$$

Where $\alpha$ is a proportional constant, $\phi$ is the number of magnetic fluxes crossing the coil 243, $d\phi/dt$ is the rate of change of the magnetic fluxes due to the motion of the magnetic rod 240, and N is the number of turns of the coil 243. If the potential Vs is correctly detected, the velocity is easily calculated from the potential Vs. However, the coil 243 is affected by not only the magnetic fluxes generated by the magnetic rod 240 but also the magnetic fluxes generated by the solenoid 226 as indicated by the loop E. The magnetic fluxes of the loop E is causative of the noise Vn, and the noise Vn is given as follows.

$$Vn=\beta\cdot v\cdot(d\phi'/dt)\cdot N \qquad \text{Equation 2}$$

where $\beta$ is proportional constant, and $\phi'$ is the number of magnetic fluxes produced by the solenoid 226 and crossing the coil 243, $d\phi/dt$ is the rate of change of the magnetic fluxes due to the motion of the magnetic rod 240. The noise Vn rides on the signal potential Vs. However, as described hereinbefore, the shield structure 244 drastically reduces the number of magnetic fluxes $\phi'$, and the noise Vn is ignoreable. The lower shield portion 244*c* further prevents the coil 243 from external magnetic influence. Thus, the shield structure 244 and the position of the magnetic rod 240 make the coil 243 and the solenoid 226 magnetically isolated from each other, and improves the signal-to-noise ratio. Moreover, the magnetic rod 240 has large impedance, and is projected from the plunger 227 in the opposite direction to the thrust exerted on the plunger 227. For this reason, the leakage magnetic fluxes of the loop E is decreased, and the manufacturer is allowed to directly connect the magnetic rod 240 to the plunger 227.

The shield structure 244 does not space the magnetic velocity sensor 207 from the solenoid-operated key actuator 206, and allows the manufacture to make the coil 243 small. This results in the compact driving unit. The shield structure 244 is not expensive, and does not increase the production cost of the automatic player piano.

Although a particular embodiment of the present invention has been shown and described, it will be obvious to those skilled in the art that various changes and modifications may be made without departing from the spirit and scope of the present invention.

For example, the acoustic piano may be an upright type, and a hammer stopper may be further incorporated in the acoustic piano so as to make the hammer assemblies 105 to rebound thereon before strike at the strings 106.

The automatic player piano may further have a recording system for recording an original performance.

The present invention is applicable to any kind of keyboard musical instrument such as a cembalo, an organ and an electronic keyboard.

What is claimed is:

1. A keyboard musical instrument comprising:

an acoustic keyboard having a plurality of keys selectively moved by a player, a plurality of vibrating members associated with said plurality of keys, a plurality of key action mechanisms respectively linked with said plurality of keys and selectively driven by said plurality of keys, and a plurality of hammers respectively driven for rotation by said plurality of key action mechanisms and selectively striking said plurality of vibrating members for producing acoustic sounds;

a plurality of solenoid-operated key actuators having respective solenoids selectively energized with driving signals and respective plungers for selectively moving said plurality of keys in the presence of magnetic field created by said solenoids;

a plurality of magnetic velocity sensors having respective magnetic rods coaxially attached to said plungers, respectively, and respective coils respectively associated with said magnetic rods for producing feedback control signals representative of current velocities of said plungers;

a controlling system connected between said plurality of solenoid-operated key actuators and said plurality of magnetic velocity sensors, and responsive to said feedback control signals for regulating the magnitude of said driving signals; and a magnetic shield structure provided between said solenoids and said coils, and shielding said coils from said magnetic field.

2. The keyboard musical instrument as set forth in claim 1, in which said shield structure has an intermediate shield portion formed of soft magnetic material and provided between said solenoids and said coils.

3. The keyboard musical instrument as set forth in claim 2, in which each of said plurality of solenoid-operated key actuators includes a bobbin having a first portion supported by a yoke and a second portion projected from said yoke into said intermediate shield portion, a coil wound on said first portion and a plunger projectable from and retractable into said solenoid, and said shield structure further includes another shield portion attached to said intermediate shield portion for accommodating said plurality of magnetic velocity sensors.

4. The keyboard musical instrument as set forth in claim 3, in which said yoke is formed of soft magnetic material, and a channel-shaped shield member of said soft magnetic material and a partition wall member of said soft magnetic material attached to said channel-shaped shield member for splitting an inner space of said channel-shaped shield member into two sub-spaces form in combination said intermediate shield portion and said another shield portion.

5. The keyboard musical instrument as set forth in claim 4, in which said soft magnetic material is iron.

6. The keyboard musical instrument as set forth in claim 1, in which said magnetic rods are directly attached to said plungers, respectively.

7. The keyboard musical instrument as set forth in claim 6, in which said magnetic rods respectively extend from said plungers in a direction opposite to a direction in which said plungers are moved in the presence of said magnetic field for moving said plurality of keys.

* * * * *